US006349715B1

(12) United States Patent
McBroom

(10) Patent No.: US 6,349,715 B1
(45) Date of Patent: Feb. 26, 2002

(54) MOBILE COOKING DEVICE

(76) Inventor: Douglas C. McBroom, 7124 Allentown Rd., Fort Washington, MD (US) 20744

( * ) Notice: Subject to any disclaimer, the term of this patent is extended or adjusted under 35 U.S.C. 154(b) by 2 days.

(21) Appl. No.: 09/709,275

(22) Filed: Nov. 10, 2000

(51) Int. Cl.[7] ..... F24C 1/16
(52) U.S. Cl. ..... 126/276; 126/37 R; 126/41 R
(58) Field of Search ..... 126/41 R, 276, 126/37 R, 37 B, 25 R; 312/236, 237, 282, 281; 296/168

(56) References Cited

U.S. PATENT DOCUMENTS 1,962,454 A * 6/1934 Meanor et al. ..... 126/268
2,862,758 A * 12/1958 Robertson ..... 126/276
3,472,219 A 10/1969 Roy et al.
3,627,396 A 12/1971 Miller
3,823,992 A 7/1974 Corbett
3,915,529 A 10/1975 Bernier
4,332,101 A 6/1982 Tomita
D285,522 S 9/1986 Basini

* cited by examiner

*Primary Examiner*—James C. Yeung

(57) ABSTRACT

A mobile cooking device for providing a mobile cart for cooking and cleaning purposes. The mobile cooking device includes a housing. The housing has a front wall, a back wall, a top wall, a bottom wall, a first side wall, and a second side wall. The second wall has a door therein. The door is selectively positioned between an open position and a closed position. An axle extends through the front and back walls. The axle is positioned generally adjacent to the second side wall. Each of a first pair of wheels is rotatably coupled to an opposite end of the axle. Each of a pair of brackets is coupled to the bottom wall and positioned generally adjacent to the first side wall. Each of a second pair of wheels is rotatably coupled to one of the brackets. A sink is positioned in the top wall of the housing. Each of a plurality of burners is positioned on the top wall of the housing. A fuel supply is fluidly coupled to each of the burners.

12 Claims, 4 Drawing Sheets

MOBILE COOKING DEVICE

BACKGROUND OF THE INVENTION

1. Field of the Invention

The present invention relates to cooking devices and more particularly pertains to a new mobile cooking device for providing a mobile cart for cooking and cleaning purposes.

2. Description of the Prior Art

The use of cooking devices is known in the prior art. More specifically, cooking devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,913,529; 3,627,396; 3,472,219; 4,332,101; 3,823,992; and U.S. Pat. Des. No. 285,522.

While these devices fulfill their respective, particular objectives and requirements, the aforementioned patents do not disclose a new mobile cooking device. The inventive device includes a housing. The housing has a front wall, a back wall, a top wall, a bottom well, a first side wall, and a second side wall. The second wall has a door therein. The door is selectively positioned between an open position and a closed position. An axle extends through the front and back walls. The axle is positioned generally adjacent to the second side wall. Each of a first pair of wheels is rotatably coupled to an opposite end of the axle. Each of a pair of brackets is coupled to the bottom wall and positioned generally adjacent to the first side wall. Each of a second pair of wheels is rotatably coupled to one of the brackets. A sink is positioned in the top wall of the housing. Each of a plurality of burners is positioned on the top wall of the housing. A fuel supply is fluidly coupled to each of the burners.

In these respects, the mobile cooking device according to the present invention substantially departs from the conventional concepts and designs of the prior art, and in so doing provides an apparatus primarily developed for the purpose of providing a mobile cart for cooking and cleaning purposes.

SUMMARY OF THE INVENTION

In view of the foregoing disadvantages inherent in the known types of cooking devices now present in the prior art, the present invention provides a new mobile cooking device construction wherein the same can be utilized for providing a mobile cart for cooking and cleaning purposes.

The general purpose of the present invention, which will be described subsequently in greater detail, is to provide a new mobile cooking device apparatus and method which has many of the advantages of the cooking devices mentioned heretofore and many novel features that result in a new mobile cooking device which is not anticipated, rendered obvious, suggested, or even implied by any of the prior art cooking devices, either alone or in any combination thereof.

To attain this, the present invention generally comprises a housing. The housing has a front wall, a back wall, a top wall, a bottom wall, a first side wall, and a second side wall. The second wall has a door therein. The door is selectively positioned between an open position and a closed position. An axle extends through the front and back walls. The axle is positioned generally adjacent to the second side wall. Each of a first pair of wheels is rotatably coupled to an opposite end of the axle. Each of a pair of brackets is coupled to the bottom wall and positioned generally adjacent to the first side wall. Each of a second pair of wheels is rotatably coupled to one of the brackets. A sink is positioned in the top wall of the housing. Each of a plurality of burners is positioned on the top wall of the housing. A fuel supply is fluidly coupled to each of the burners.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new mobile cooking device apparatus and method which has many of the advantages of the cooking devices mentioned heretofore and many novel features that result in a new mobile cooking device which is not anticipated, rendered obvious, suggested, or even implied by any of the prior art cooking devices, either alone or in any combination thereof.

It is another object of the present invention to provide a new mobile cooking device which may be easily and efficiently manufactured and marketed.

It is a further object of the present invention to provide a new mobile cooking device which is of a durable and reliable construction.

An even further object of the present invention is to provide a new mobile cooking device which is susceptible of a low cost of manufacture with regard to both materials and labor, and which accordingly is then susceptible of low prices of sale to the consuming public, thereby making such mobile cooking device economically available to the buying public.

Still yet another object of the present invention is to provide a new mobile cooking device which provides in the apparatuses and methods of the prior art some of the advantages thereof, while simultaneously overcoming some of the disadvantages normally associated therewith.

Still another object of the present invention is to provide a new mobile cooking device for providing a mobile cart for cooking and cleaning purposes.

Yet another object of the present invention is to provide a new mobile cooking device which includes a housing. The housing has a front wall, a back wall, a top wall, a bottom wall, a first side wall, and a second side wall. The second wall has a door therein. The door is selectively positioned between an open position and a closed position. An axle extends through the front and back walls. The axle is positioned generally adjacent to the second side wall. Each of a first pair of wheels is rotatably coupled to an opposite end of the axle. Each of a pair of brackets is coupled to the bottom wall and positioned generally adjacent to the first side wall. Each of a second pair of wheels is rotatably coupled to one of the brackets. A sink is positioned in the top wall of the housing. Each of a plurality of burners is positioned on the top wall of the housing. A fuel supply is fluidly coupled to each of the burners.

Still yet another object of the present invention is to provide a new mobile cooking device that has a sink capable of being coupled to fresh supply of water.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
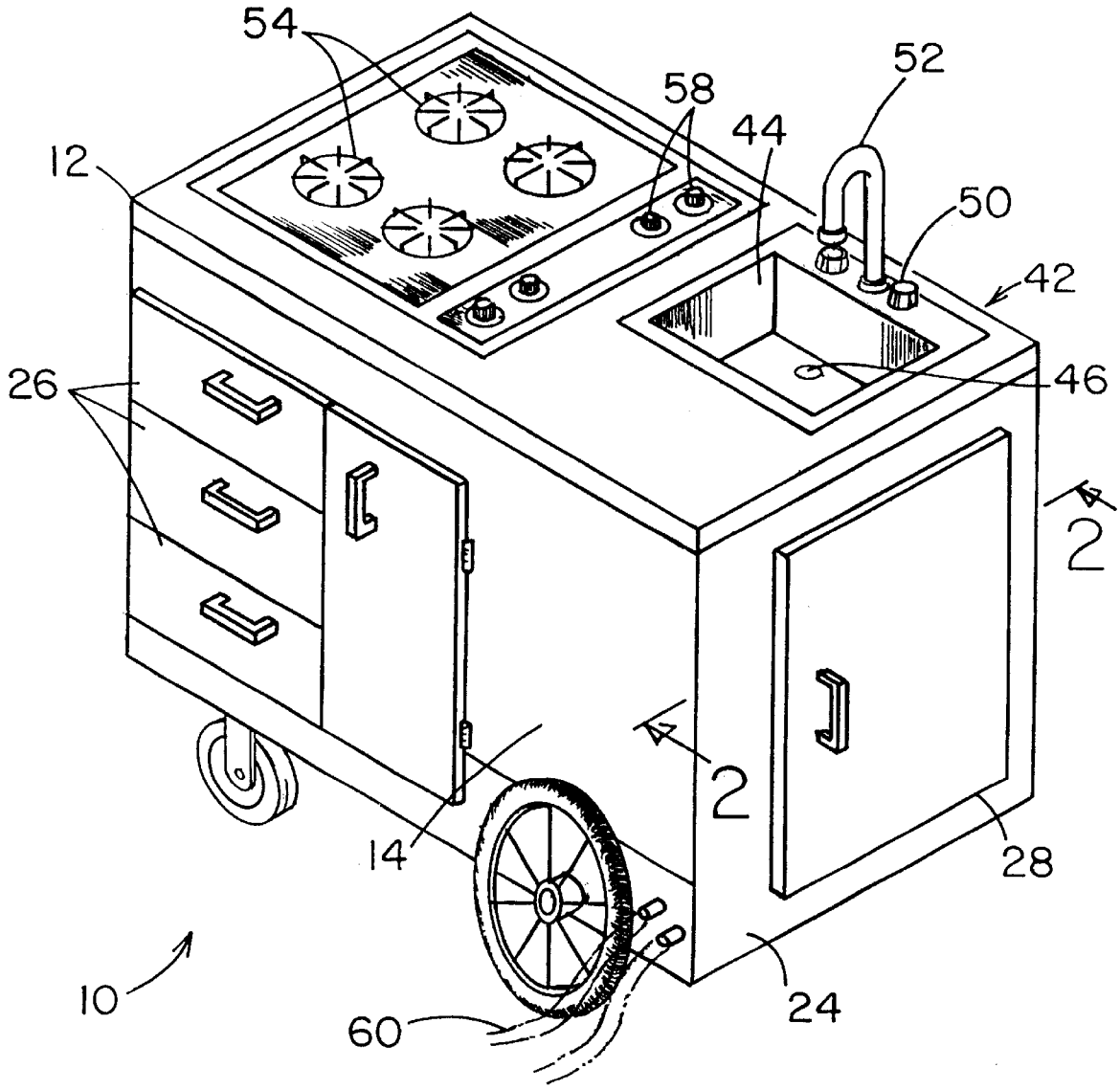
FIG. 1 is a schematic perspective view of a new mobile cooking device according to the present invention.
Figure 2:
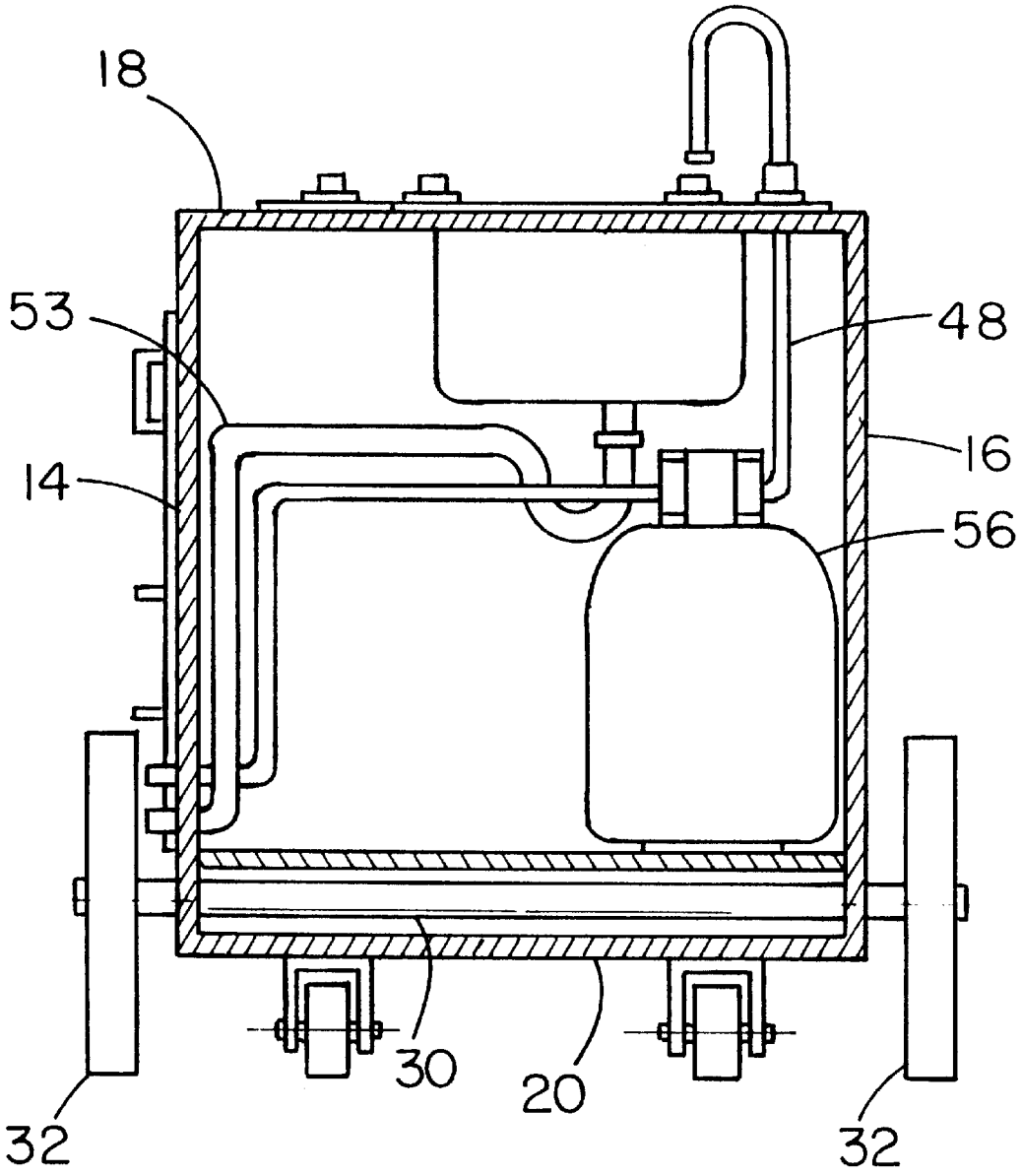
FIG. 2 is a schematic cross-sectional view taken along line 2—2 of the present invention.
Figure 3:
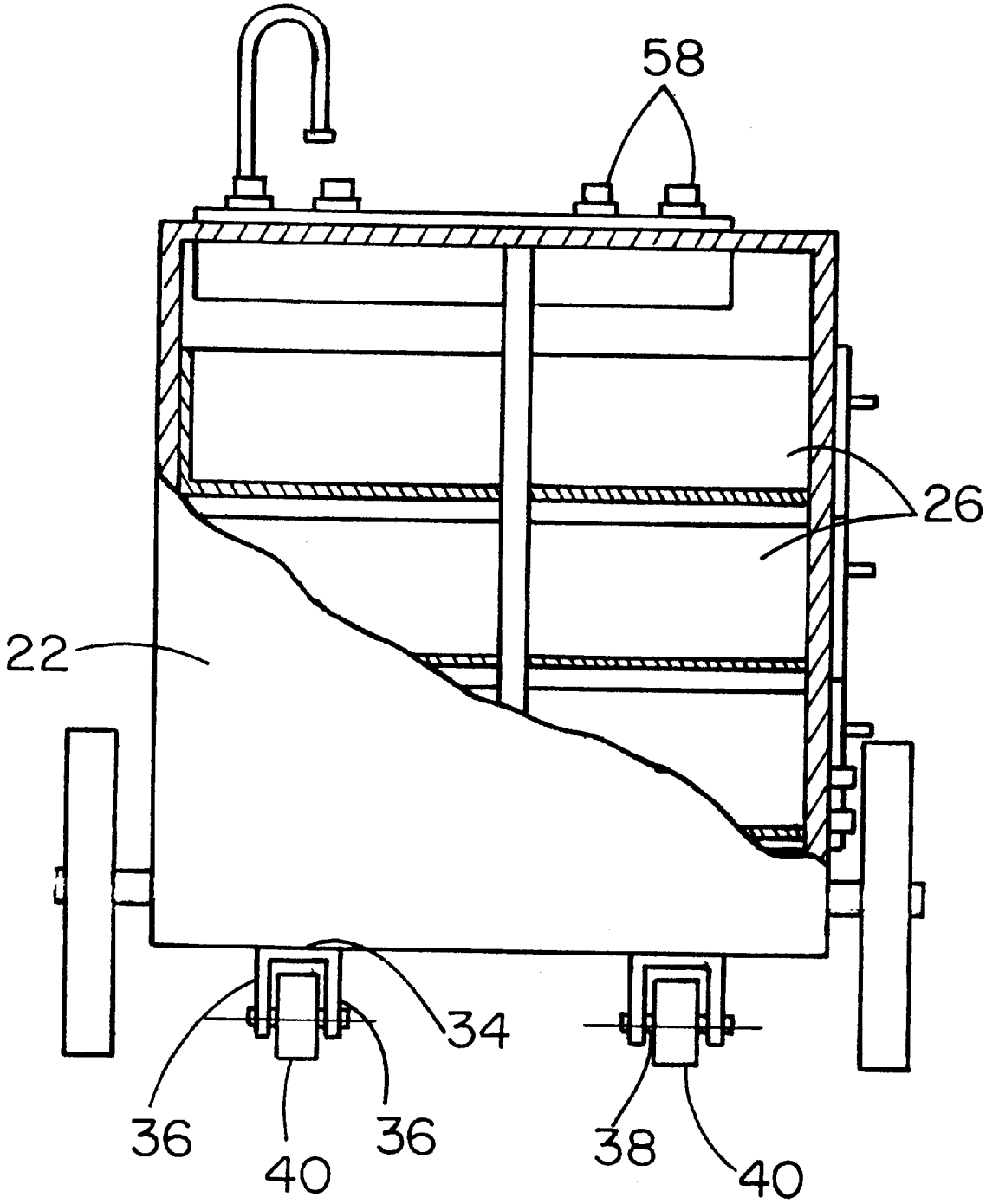
FIG. 3 is a schematic side broken view of the present invention.
Figure 4:
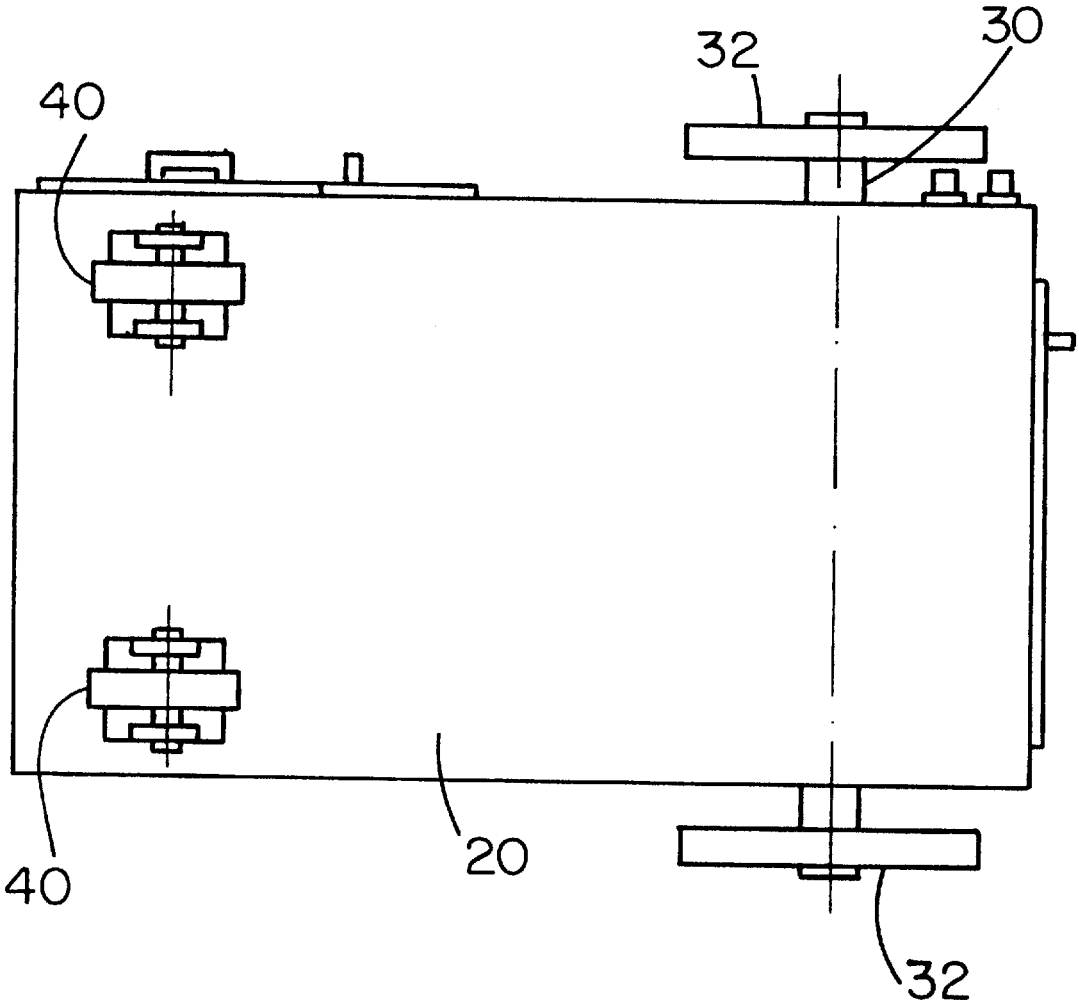
FIG. 4 is a schematic bottom view of the present invention.

With reference now to the drawings, and in particular to FIGS. 1 through 4 thereof, a new mobile cooking device embodying the principles and concepts of the present invention and generally designated by the reference numeral 10 will be described.

As best illustrated in FIGS. 1 through 4, the mobile cooking device 10 generally comprises a housing 12. The housing 12 has a front wall 14, a back wall 16, a top wall 18, a bottom wall 20, a first side wall 22, and a second side wall 24. The front wall 14 has a plurality of drawers 26 extendably positioned therein. Each of the drawers 26 is positioned generally adjacent to the first side wall 22. The second wall 24 has a door 28 therein. The door 28 is hingedly coupled to the housing 12 and is selectively positioned between an open position and a closed position.

An axle 30 extends through the front 14 and back 16 walls. The axle 30 is positioned generally adjacent to the second side wall 24. Each of a first pair of wheels 32 is rotatably coupled to an opposite end of the axle 30.

Each of pair of brackets includes a plate 34. Each of the plates 34 is pivotally coupled to the bottom wall 20. Each of the plates 34 is positioned generally adjacent to the first side wall 22. The plates 34 are each generally positioned adjacent to one of the front 14 and back 16 walls. Each of the plates 34 has a pair of legs 36 coupled thereto. The legs each has a hole therethrough such that each of the brackets defines a clevis. Each of a pair of rods 38 extends through a pair of respective holes. Each of a the rods 38 extends through one of the wheels 40 of a second pair of wheels 40 such that each of the second pair of wheels 40 is rotatably coupled to one of the rods 38.

A sink 42 positioned in the top wall 18 of the housing 12. The sink 42 is positioned generally adjacent to the second side wall 24. The sink 42 includes a tub portion 44 extending downwardly into the housing 12. The tub portion 44 has a drain hole 46. An inlet hose 48 extends through the front wall 14 to the tub portion 44. A valve 50 is positioned on the tub portion 44 and is fluidly coupled to the inlet hose 48. A faucet 52 is fluidly coupled to the valve 50. The valve 50 and faucet 52 being conventional. An outlet hose 53 extends through the front wall 14 and is fluidly coupled to the drain hole 46.

Each of a plurality of burners 54 is positioned on the top wall 18 of the housing 12. A fuel supply 56 preferably comprises a propane tank. The propane take 56 is positionable in the housing 12 and is fluidly coupled to each of the burners 54. A plurality of actuating means 58 selectively turns each of the burners 54 on or off. Each of the actuating means 58 is mechanically coupled to one of the burners 54. The combination of burners 54, propane tank 56 and actuating means 58 are a conventional combination found in gas grills.

In use, a water supply 60 is fluidly coupled to the intake hose 48 for supplying water to the faucet 52. The burners 54 are used as conventional burners and the drawers 26 allow for storage of food an utensils.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mobile cooking apparatus, said apparatus comprising:

a housing, said housing having a front wall, a back wall, a top wall, a bottom wall, a first side wall, and a second side wall, said second wall having a door therein, said door being selectively positioned between an open position and a closed position;

an axle, said axle extending through said front and back walls, said axle being positioned generally adjacent to said second side wall;

a first pair of wheels, each of said first pair of wheels being rotatably coupled to an opposite end of said axle;

a pair of brackets, each of said brackets being coupled to said bottom wall and positioned generally adjacent to said first side wall;

a second pair of wheels, each of said second pair of wheels being rotatably coupled to one of said brackets;

a sink, said sink being positioned in said top wall of said housing, said sink being positioned generally adjacent to said second side wall;

a plurality of burners, each of said burners being positioned on said top wall of said housing; and a fuel supply, said fuel supply being fluidly coupled to each of said burners;

wherein said front wall of said housing has a plurality of drawers extendably positioned therein, each of said drawers being positioned generally adjacent to said first side wall.

2. The mobile cooking apparatus as in claim 1, wherein each of said brackets comprises:

a plate, each of said plates being pivotally coupled to said bottom wall, each of said plates being positioned generally adjacent to said first side wall, each of said plates being generally positioned adjacent to one of said front and back walls, each of said plates having a pair of legs coupled thereto, each of said legs having a hole therethrough such that each of said brackets defines a clevis, each of a pair of rods extending through a pair of respective holes, each of said rods extending through one of said wheels of said second pair of wheels such that each of said second pair of wheels is rotatably coupled to one of said rods.

3. The mobile cooking apparatus as in claim 1, wherein said sink comprises:

a tub portion, said tub portion extending downwardly into said housing, said tub portion having a drain hole;

an inlet hose, said inlet hose extending through said front wall to said tub portion;

a valve, said valve being positioned on said tub portion and being fluidly coupled to said inlet hose;

a faucet, said faucet being fluidly coupled to said valve;

an outlet hose, said outlet hose extending through said front wall and being fluidly coupled to said drain hole.

4. The mobile cooking apparatus as in claim 1, further comprising:

a plurality of actuating means for selectively turning each of said burners on or off, each of said actuating means being mechanically coupled to one of said burners.

5. The mobile cooking apparatus as in claim 1, further comprising:

a plurality of actuating means for selectively turning each of said burners on or off, each of said actuating means being mechanically coupled to one of said burners.

6. A mobile cooking apparatus, said apparatus comprising:

a housing, said housing having a front wall, a back wall, a top wall, a bottom wall, a first side wall, and a second side wall, said front wall having a plurality of drawers extendably positioned therein, each of said drawers being positioned generally adjacent to said first side wall, said second wall having a door therein, said door being selectively positioned between an open position and a closed position;

an axle, said axle extending through said front and back walls, said axle being positioned generally adjacent to said second side wall;

a first pair of wheels, each of said first pair of wheels being rotatably coupled to an opposite end of said axle;

a pair of brackets, each said pair of brackets including a plate, each of said plates being pivotally coupled to said bottom wall, each of said plates being positioned generally adjacent to said first side wall, each of said plates being generally positioned adjacent to one of said front and back walls, each of said plates having a pair of legs coupled thereto, each of said legs having a hole therethrough such that each of said brackets defines a clevis, each of a pair of rods extending through a pair of respective holes;

a second pair of wheels, each of said rods extending through one of said wheels of said second pair of wheels such that each of said second pair of wheels is rotatably coupled to one of said rods;

a sink, said sink being positioned in the said top wall of said housing, said sink being positioned generally adjacent to said second side wall, said sink comprising;

a tub portion, said tub portion extending downwardly into said housing, said tub portion having a drain hole;

an inlet hose, said inlet hose extending through said front wall to said tub portion;

a valve, said valve being positioned on said tub portion and being fluidly coupled to said inlet hose;

a faucet, said faucet being fluidly coupled to said valve;

an outlet hose, said outlet hose extending through said front wall and being fluidly coupled to said drain hole;

a plurality of burners, each of said burners being positioned on said top wall of said housing;

a fuel supply, said fuel supply comprising a propane tank, said propane take being positionable in said housing and being fluidly coupled to each of said burners; and a plurality of actuating means for selectively turning each of said burners on or off, each of said actuating means being mechanically coupled to one of said burners.

7. A mobile cooking apparatus comprising:

a housing having a front wall, a back wall, a top wall, a bottom wall, a first side wall, and a second side wall, said second wall having a door therein, said door being selectively positioned between an open position and a closed position;

a sink positioned in said top wall of said housing, said sink being positioned generally adjacent to said second side wall;

a plurality of burners positioned on the top wall of said housing; and a fuel supply being fluidly coupled to each of said burners;

wherein said front wall of said housing has a plurality of drawers extendably positioned therein, each of said drawers being positioned generally adjacent to said first side wall.

8. The mobile cooking apparatus as in claim 7, additionally comprising:

an axle extending through said front and back walls, said axle being positioned generally adjacent to said second side wall;

a first pair of wheels, each of said first pair of wheels being rotatably coupled to an opposite end of said axle;

a pair of brackets, each of said brackets being coupled to said bottom wall and positioned generally adjacent to said first side wall; and a second pair of wheels, each of said second pair of wheels being rotatably coupled to one of said brackets.

9. The mobile cooking apparatus as in claim 7, wherein each of said brackets comprises a plate, each of said plates being pivotally coupled to said bottom wall, each of said plates being positioned generally adjacent to said first side wall, each of said plates being generally positioned adjacent to one of said front and back walls, each of said plates having a pair of legs coupled thereto, each of said legs having a hole therethrough such that each of said brackets defines a clevis, each of a pair of rods extending through a pair of respective holes, each of said rods extending through one of said wheels of said second pair of wheels such that each of said second pair of wheels is rotatably coupled to one of said rods.

10. The mobile cooking apparatus as in claim 7, wherein said sink comprises:

a tub portion, said tub portion extending downwardly into said housing, said tub portion having a drain hole;

an inlet hose, said inlet hose extending through said front wall to said tub portion;

a valve, said valve being positioned on said tub portion and being fluidly coupled to said inlet hose;

a faucet, said faucet being fluidly coupled to said valve;

an outlet hose, said outlet hose extending through said front wall and being fluidly coupled to said drain hole.

11. The mobile cooking apparatus as in claim 7, further comprising a plurality of actuating means for selectively turning each of said burners on or off, each of said actuating means being mechanically coupled to one of said burners.

12. The mobile cooking apparatus as in claim 7, further comprising a plurality of actuating means for selectively turning each of said burners on or off, each of said actuating means being operationally connected to one of said burners.

* * * * *